US005425191A

United States Patent [19]

Taylor et al.

[11] Patent Number: 5,425,191

[45] Date of Patent: Jun. 20, 1995

[54] GUN SIGHT MOUNTS

[75] Inventors: Hugh F. Taylor; David R. Theobald, both of St. Ives; Derek J. C. Bernard, St. Clement, all of Great Britain

[73] Assignee: Utec B.V., Driebergen, Netherlands

[21] Appl. No.: 163,047

[22] Filed: Dec. 6, 1993

[30] Foreign Application Priority Data

Dec. 5, 1992 [GB] United Kingdom ..... 9225501
Dec. 17, 1992 [GB] United Kingdom ..... 9226275

[51] Int. Cl.[6] ..... F41G 1/387
[52] U.S. Cl. ..... 42/101; 33/245
[58] Field of Search ..... 42/101; 33/245, 247, 33/248, 250

[56] References Cited

U.S. PATENT DOCUMENTS

| | | | |
|---|---|---|---|
| 3,205,580 | 9/1965 | Osborn | 33/245 |
| 3,260,008 | 7/1966 | Yeomans | 42/101 |
| 3,299,558 | 1/1967 | Karl | 42/101 |
| 3,374,544 | 3/1968 | Pitchford | 33/247 |
| 3,483,623 | 12/1969 | Kruzell | 42/101 |
| 3,750,318 | 8/1973 | Burris | 42/101 |
| 3,877,166 | 4/1975 | Ward | 42/101 |
| 4,027,414 | 6/1977 | Felix | 42/101 |
| 4,446,644 | 5/1984 | Jimenez | 42/101 |
| 4,769,938 | 9/1988 | Chesnut et al. | 42/101 |
| 4,776,126 | 10/1988 | Williams | 42/101 |

FOREIGN PATENT DOCUMENTS

| | | |
|---|---|---|
| 0444300 | 9/1991 | European Pat. Off. . |
| 2544063 | 10/1984 | France . |
| 2581746 | 11/1986 | France . |
| 752966 | 7/1956 | United Kingdom . |
| 2175676 | 12/1986 | United Kingdom . |

*Primary Examiner*—Charles T. Jordan
*Attorney, Agent, or Firm*—Lee, Mann, Smith, McWilliams, Sweeney & Ohlson

[57] ABSTRACT

A telescopic gun sight is clamped to a mount which is mounted on a base for limited relative sliding movement fore and aft of the barrel of a rifle, to which the base is secured. Resilient bushes of elastomeric material are disposed within bores in the mount, and fixing bolts pass through the bushes to clamp the mount to the base. The resilience of the bushes allows the mount to move slightly relative to the base, and returns the mount to its original datum position after such movement. In this way, shocks that may otherwise damage the sight and/or shift its position relative to the barrel of the rifle may be absorbed—particularly recoil shocks upon firing. In other embodiments, relative movement of a mount relative to a base is possible in more than one direction, thereby to absorb shocks in other directions, as may be caused by, for example, accidental knocks.

14 Claims, 4 Drawing Sheets

GUN SIGHT MOUNTS

This invention relates to gun sight mounts. It may find application in mounting systems for optical and other relatively large and/or heavy or delicate sights on rifles and pistols in general, and in mounting telescopic sights on spring-operated airguns in particular.

The use of telescopic, electronic ("red dot") and laser sighting systems has expanded substantially in recent years, perhaps particularly so in connection with pistols and, especially, high-performance air-rifles. High standards of accuracy are always a major objective when fitting such sights. To maintain such high standards without repeated re-zeroing requires a spatial relationship between the sighting system and the gun which is very substantially the same as each successive shot is fired. It will be appreciated that the effect of even very small, non-reversible, relative movements between the sighting system and the gun which affect the relationship between the longitudinal axes of the gun barrel and the sighting system, will be greatly magnified by the distance travelled by the projectile.

This desired relationship may be permanently disturbed in a number of unplanned ways, of which the principal ones are probably:

1. The effects of the firing process.
2. Accidental knocks.
3. Removal and replacement.

Each of these will be considered briefly.

1. The Firing Process.

Under Newton's Third Law, the momentum of a projectile travelling down a gun barrel and of the expanding, high-pressure, propellant gas behind it, will be equalled by the momentum of the gun travelling in the opposite direction. Additionally, when the projectile leaves the barrel, the constrained propellant gases behind it will, in effect, be released, will accelerate greatly and will increase the momentum of the gun moving in the opposite direction.

The above effects, commonly collectively referred to as "recoil", will apply to all conventional guns. This recoil is a rapid impulse, repeated with every shot. If a telescopic or electronic sight is fitted, then Newton's First Law requires that a force is applied to the sight to overcome its inertia and make it recoil with the gun. This force will be transmitted via the mounting system for the sight. If the recoil is relatively severe and if the interface between either the gun and the mounting system or the mounting system and the sight is not secure, small non-reversible relative movements may occur between the gun and the sight at each shot. Cumulatively this is commonly referred to as "creep" and may lead to significant inaccuracy.

The same dynamic process occurs to each component inside the sight. Thus, if such a component is not mounted securely, it may come loose inside the sight, or, if it is relatively fragile (such as the reticle), it may break.

The momemtum formula can be expressed as:

$$M_1V_1=M_2V_2+M_3V_3+M_4V_4$$

where $M_1$=mass of the gun
$M_2$=mass of the projectile
$M_3$=mass of the propellant gases $V_1$=velocity of the gun
$V_2$=velocity of the projectile
$V_3$=average velocity of the gases while in the barrel
$V_4$=average velocity of the gases on leaving the barrel.

Clearly, where the mass of the gun is high in relation to the combined mass of the projectile and gases, the velocity of the recoiling gun will be a small fraction of the velocity of the projectile. Thus, using simplified examples (and excluding the momentum effects of the moving gases), if the gun is a smallbore target rifle weighing 5 kg. ($M_1$), firing a projectile weighing 3 g ($M_2$) at a muzzle velocity of 300 m/sec. ($V_2$), then $$V_1=3\times300\div5{,}000=0.18 \text{ m/sec.},$$

i.e. the rifle would recoil very slowly. In the case of a low-powered 4.5 mm target air rifle, pre-charged with compressed gas, weighing 4 kg., and firing a projectile weighing 0.5 g at 200 m/sec, then $$V_1=0.5\times200\div4{,}000=0.025 \text{ m/sec.},$$

i.e. the rifle would recoil extremely slowly.

At the other end of the spectrum, a high-powered hunting rifle might weight 3 kg and fire a projectile weighing 10 g at 1,000 m/sec. In which case, $$V_1=10\times1{,}000\div3{,}000=3.3 \text{ m/sec.},$$

which would be very noticeable indeed. Such rifles are highly likely to be fitted with telescopic sights.

A high-powered pistol might weigh 1 kg. and fire a 10 g. projectile at 400 m/sec. In which case $$V_1=10\times400\div1{,}000=4 \text{ m/sec.}$$

Again, this recoil speed would be very noticeable. In addition, the short barrel of a pistol will require a relatively fast-burning propellant, so that the recoil speed will be reached very rapidly. As stated earlier, the use of telescopic and electronic sights on pistols has grown rapidly in recent years.

In spring-operated airguns, as opposed to those pre-charged with compressed gas, an additional and unique recoil problem arises. Typically, the firing process will involve releasing a previously-cocked, powerful spring; this will rapidly accelerate a relatively heavy piston (weighing, perhaps, 300/500 g.) along a cylinder, quickly compressing the air ahead of it; the compressed air will flow through a transfer port between the end of the cylinder and the barrel, where it will be available to propel a pellet or other projectile along and out of the barrel. More or less simultaneously, the piston will come to a very abrupt halt as it reaches the end of the cylinder. Very often, the piston will bounce before coming to rest.

Clearly, Newton's Third Law will apply to such an airgun in terms of the relative movement between the pellet and the gun but, as we have seen above, the recoil velocity of an airgun arising from the pellet movement only is likely to be relatively low. Additionally and crucially, however, Newton's Third Law will also apply to the relative movement between the airgun and the piston.

Typically, the cylinder will be behind the barrel and the piston will move forward towards the barrel during the firing stroke and thus the gun will recoil backwards.

When the piston reaches the end of its strike, however, and strikes the cylinder head, the gun's rearward motion will be brought to a rapid halt and then the gun will move in the opposite direction, away from the firer. This unusual "whiplash" movement has been analysed in some detail by a leading British airgun researcher, Mr Gerald Cardew of Birmingham, England. In an article in the February 1990 issue of the British monthly magazine "Airgunner", Mr Cardew described his research into the recoil movements of a Weihrauch HW80, a conventional spring-operated air-rifle, at two different powers. The oscilloscope traces of the rifle recoil are shown in FIGS. 1 and 2 of the accompanying diagrammatic drawings.

FIG. 1 shows the movement of the rifle when firing a 14.4 grain pellet at a muzzle velocity of 575 ft/sec. FIG. 2 shows the movement of the same gun firing the same weight pellet at 780 ft/sec., representing a muzzle energy increase of some 84%. In both cases, the trace was started when the gun was fired and stopped when the pellet left the barrel. The first downward section of each trace represents the rearward recoil of the gun in response to the forward movement of the piston; and the final, upward section represents the forward movement of the rifle in response to the impact of the piston. The time taken to slow down, stop and accelerate up to a constant velocity in the opposite direction is indicated by the horizontal component of the radii between the two straight sections.

In both of the Figures, each vertical unit represents a longitudinal gun movement of about ⅛th inch and each horizontal unit an elapsed time of 2 milliseconds. Attention is drawn to both the increased steepness of the trace (and therefore the velocity of the gun) and the dramatically reduced time during which the change of direction occurred in FIG. 2, as compared with FIG. 1.

In FIG. 1, the velocity in both directions would appear to be approximately 3 ft/sec. and the change of direction to have taken about 2 milliseconds. Therefore, the average acceleration during the change can be determined by the formula $V=u+at$, where $V$=final velocity, $u$=starting velocity, $a$=acceleration and $t$=time.

Thus, $$3=-3+0.002a$$

$$a=6\div 0.002=3{,}000\ \text{ft/sec}^2$$

$$\approx 100\ \text{g.}$$

In FIG. 2, the starting velocity would appear to be about 4 ft/sec., the final velocity about 8 ft/sec. and the time taken to change direction about 0.2 milliseconds.

Thus, $$8=-4+0.0002a$$

$$a=12\div 0.0002=60{,}000\ \text{ft/sec2}$$

$$\approx 2{,}000\ \text{g.}$$

The calculated figures are not especially important, partly because they are based on a single experiment with a single rifle and partly because the scale of the trace in FIG. 2 is inadequate for the job. What is important is the dramatic rise in rates of acceleration (and, therefore, inertia forces on any sights and mounting systems) with increased power.

In practice, it is common for telescopic sights and/or their mounts to tend to "creep" i.e. make very small incremental movements at each shot, when fitted to powerful spring-operated airguns. Reference to this problem can be found in the 1984, 3rd edition of "The Airgun Book" by John Walter, on page 43.

Less commonly, but more seriously, telescopic sight reticles and other internal components sometimes fail to stand up to the loads involved. It is interesting to note that Leupold & Stevens Inc., a leading American manufacturer of high-quality telescopic sights, draws attention to this problem on page 19 of their 1992 catalogue, with a claim that whereas "most brands (of telescopic sights) aren't capable of taking this bizarre abuse", their own products can.

2. Accidental Knocks

It will readily be appreciated that telescopic or other sighting systems which project substantially from the gun are exposed to accidental knocks.

This can happen in almost any circumstances but is, perhaps, particularly likely in a hunting situation.

3. Removal and Replacement

It is often desirable to be able to remove telescopic sights—for example, to service the gun or to use the same (expensive) sight on several different guns, and it is a clear advantage if the sight can be removed and remounted easily and quickly, without losing the previous zero.

In the prior art, as a generality, the approach taken to overcoming the problems created by both the firing process and accidental knocks is to devise improved clamping means, thereby eliminating any possible relative movement between the sight and the mount and the mount and the gun.

At a basic level this may consist of "arrester blocks" bolted to the gun at either or both ends of the mount. Examples of more sophisticated approaches are represented by U.S. Pat. No. 4,446,644 and U.K.P. 2,175,676. With respect to U.K.P. 2,175,676 it is interesting to note that, although the described invention results in practice in an extremely tight grip between the carrier and the rifle body, so tight indeed that considerable use of a mallet is required to engage or disengage the carrier, creep still tends to occur upon firing and the manufacturer has found it essential to complete the assembly of the carrier to the rifle with a bolt, which is foreshadowed in the specification (page 2, lines 29 to 33). The bolt head is located in a hole in the carrier and the bolt is screwed into the rifle body, thus eliminating any possibility of relative longitudinal movement between the mount and the rifle. Because of this necessarily rigid radial connection, it is, in fact, clearly impossible for the rubber pads or strips 11 to provide any material longitudinal shock-absorbing properties, as would be essential to inhibit the transmission of shocks to the sight upon firing.

A great deal of ingenuity and thought over many years has gone into devising mounting systems that are easy and quick to remove or replace and which tend to return to within a small margin of zero. By reputation, several of these work well.

Examples of prior art are U.K.P. 752,966, U.S. Pat. No. 3,750,318 and U.S. Pat. No. 3,877,166. It will be seen that all appear to achieve a close and rigid mechanical relationship between the gun and the sight. In addition, however, they comprise several components, which generally appear to require to be made to fine tolerances. They are thus likely to be expensive.

Proposals have been made for utilising metallic springs for absorbing shock in guns. See, for example, European Patent Specification EP 2 581 746 A and U.S. Pat. No. 4,027,414. However, problems with metallic springs tend to be that their spring coefficients can change with time and use, they cannot easily be used to connect together two parts such as a gun sight mount and a base therefor, and they tend to provide a spring force in only one line of action.

According to one aspect of the present invention, there is provided a mounting assembly for a gun sight, the assembly comprising:

a base which is integral with, secured to, or adapted to be secured to, a gun barrel;

a mount which is integral with, carries, or is adapted to receive, a gun sight; and shock-absorbing means for absorbing shocks which would otherwise be transmitted, in use, between a gun and gun sight:

wherein said shock-absorbing means comprises at least one body of elastomeric material which has first and second faces and is secured between said base and mount such that said first and second faces are in contact with said base and mount respectively and, in at least one direction, no relative movement is possible between said first face and said base and no relative movement is possible between said second face and said mount, the elastomeric material between said faces being resiliently deformable to allow limited relative movement between the mount and the base in at least said one direction, and to urge the mount and base to return to a rest position under the resilient bias of the elastomeric material, following said limited relative movement.

At least one of said first and second faces may be bonded to said base or mount respectively.

At least one of said first and second faces may abut an abutment face of said base or mount respectively, to prevent, in at least said one direction, relative movement between said first face and said base or between said second face and said mount, respectively.

Preferably, the or at least one of the said abutment face(s) extends substantially at right angles to said one direction.

A mounting assembly as above may further comprise a fastening member which passes through said body to fasten said body to said base or mount.

Preferably, said fastening member extends in a direction which extends substantially at right angles to said one direction.

Said body may comprise a bush of said elastomeric material.

Preferably, said elastomeric material comprises a natural and/or synthetic rubber.

Preferably, said one direction extends substantially parallel to the longitudinal axis of a gun barrel in use of the mounting assembly.

Means may be provided for restraining movement of said elastomeric material transversely of said one direction.

Said elastomeric material may be resiliently deformable transversely of said one direction, to allow limited relative movement of said mount and base transversely of said one direction.

Said elastomeric material may be resiliently deformable in all directions, to allow limited relative movement of said and base in all directions.

The or each said body may provide the only physical connection between said base and mount.

At least one of said first and second faces may be provided on a layer of a protective material in contact with said elastomeric material. For example, such a layer may comprise a metallic member—or a member of another material that is hard relative to the elastomeric material. Such a member may comprise an inner or outer sleeve, when the said body is in the form of a bush. Thus, it will be appreciated that, in the context of this specification, the term "body of elastomeric material" is not limited to a body that comprises only elastomeric material, but includes additional materials such as, for example, a layer of protective material as mentioned above.

The invention extends to, in combination, a mounting assembly according to any of the preceding aspects of the invention, together with a gun sight mounted in said mount.

The invention extends also to a gun provided with a mounting assembly or combination according to any of the preceding aspects of the invention.

For a better understanding of the invention, and to show how embodiments of the same may be carried into effect, reference will now be made, by way of example, to FIGS. 3 to 10 of the accompanying diagrammatic drawings, in which.

In the figures, like reference numerals denote like or corresponding parts.

Figure 1:
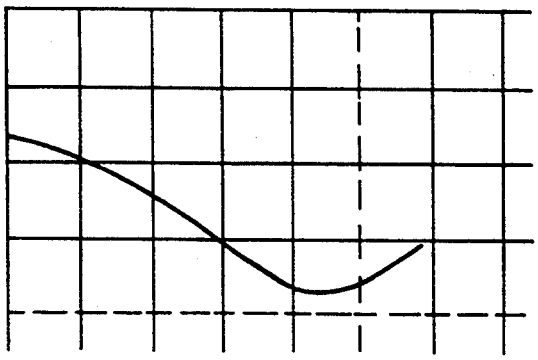
Figure 2:
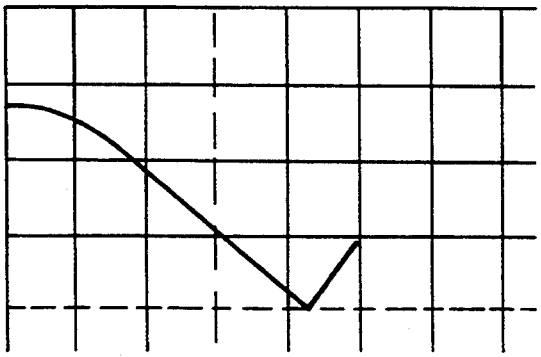
Figure 3:
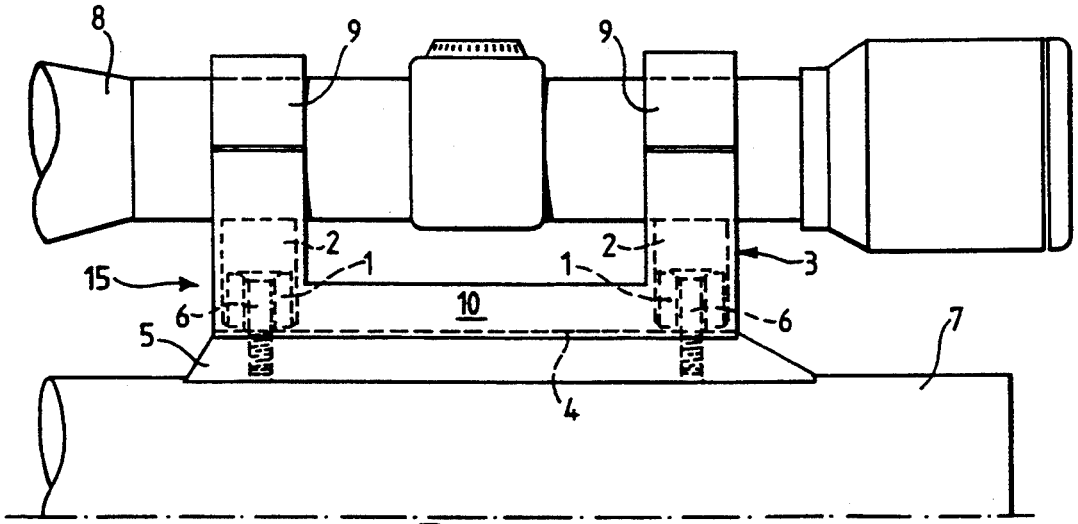
FIG. 3 shows a gun sight mounted on a gun barrel by means of one example of a mounting assembly in accordance with the invention.

The mounting assembly 15 illustrated in FIGS. 3 to 6 uses "Metalastic"-type bushes 1 as a resilient shock-absorbing means, connecting a mount 3 with a base 5.

Each of two bushes 1 is located in a respective one of two counterbored sockets 2 in the mount 3. A machined channel 4 on the mount 3 slidingly engages precisely, in firm sliding contact with a rail 14 on the base 5, so that the mount 3 may slide fore and aft along the base 5, substantially parallel to the longitudinal axis of a barrel of a rifle 7. The mount 3 is also clamped to the base 5 by countersunk screws 6 which pass through the bushes 1. The base 5 is rigidly attached to the barrel of the rifle 7 either permanently, by means such as welding, or removably, through known means such as dovetail grooves and clamps. A telescopic sight 8 is rigidly secured to the mount 3 by means of conventional ring clamps 9.

Figure 4A:
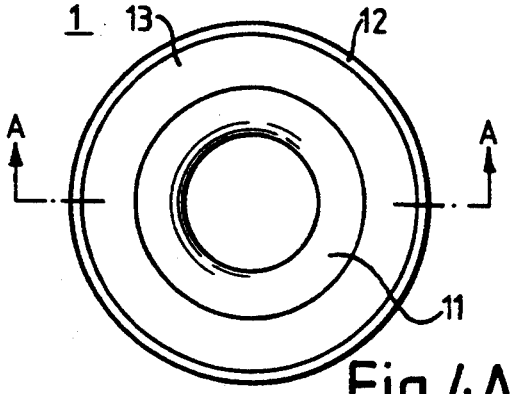
FIGS. 4A and 4B show a bush of the assembly of FIG. 3, respectively in plan view and cross-section.
Figure 4B:
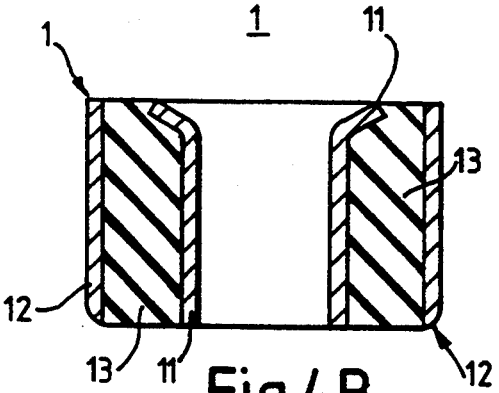

FIGS. 4A and 4B shows one of the bushes 1 in more detail. It will be seen that it consists of an inner metal sleeve 11 and an outer metal sleeve 12, which is separated by a natural and/or synthetic rubber material 13 which is bonded to both.

Figure 5:
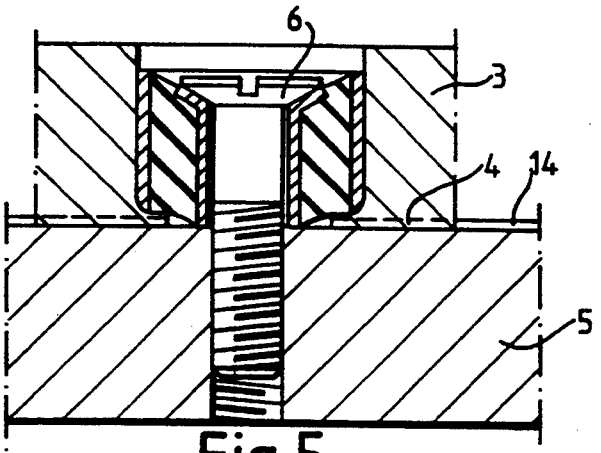
FIG. 5 is a cross-sectional view of the bush of FIGS. 4A and 4B, in use.
Figure 6A:
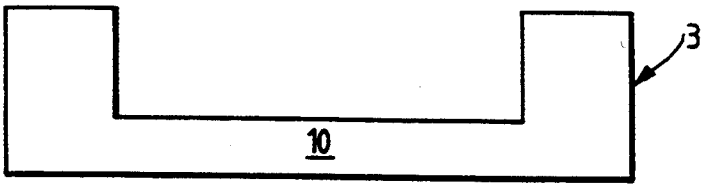
FIGS. 6A, 6B and 6C show a mount of the assembly of FIG. 3, respectively in side elevation, end elevation, and plan view.
Figure 6B:
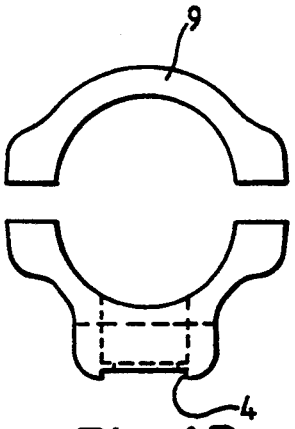
Figure 6C:
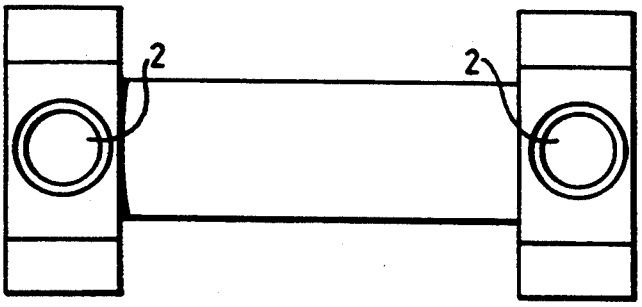

FIG. 5 shows the bush 1 in use between the mount 3 and base 5. It will be seen that the screw 6 can be used to provide a moderate clamping force to hold the mount 3 in close, sliding relationship to the base 5. In this embodiment, the elastomeric material 13 is used at least partially to transmit a clamping force between the mount 3 and the base 5.

The embodiment illustrated in FIGS. 3 to 6 may overcome the problems identified above, in relation to shocks that may be transmitted between a gun and its sight, by introducing controlled resilience between the sight 8 and the rifle 7, by means of the resilient self-centering action of the bushes 1. By this means, relative movement between the sight 8 and the rifle 7 is permitted, for example, during the firing process or through an accidental blow, but as soon as the force causing the relative movement ceases to be applied, the resilient restoring force of the bushes 1 will automatically restore the relative positions of the sight 8 and the rifle 7 to those held previously. By this means, the inertia forces can be very greatly reduced, completely eliminating both reticle breakage and creep as a result of the firing process, even on extremely powerful spring-operated airguns. It reduces the common need to overtighten the clamps 9 on the sight 8 (and thus possibly damage the sight tube) to try to stop the sight 8 "creeping" through the mount 3. It also reduces the possibility of an accidental blow permanently disturbing the relationship between the sight 8 and the rifle 7, possibly without the knowledge of the user.

Other embodiments of the invention can be performed in a number of ways. What is important is that, in preferred embodiments of the invention, the resilient means is/are sufficiently flexible to permit enough relative travel (approximately +/− 1 mm has been found to be satisfactory in trials); sufficiently stiff to avoid perceptible quivering; and sufficiently elastic to ensure accurate and consistent return to datum after being disturbed. In trials, an elastomeric material comprising EPDM rubber and having a Shore hardness of 70 has been found to be satisfactory. In addition, the ultimate strength of the connection must be adequate; it is obviously desirable that manufacturing and assembly costs are low; and that the system can readily be attached to a wide range of guns—e.g. using standard dovetails.

In a variant of the embodiment of FIGS. 3 to 6, a bush 1 could be used additionally, or in place of the illustrated bushes 1, through a cross-member 10 of the mount 3 into the base 5. If engaging channel 4 were substantially deeper than shown, then one or more centrally-located bushes 1 could be mounted with their axes extending horizontally rather than vertically. Such an arrangement would allow the whole telescopic sight and mount assembly to be removed and replaced very rapidly and accurately.

Figure 7:
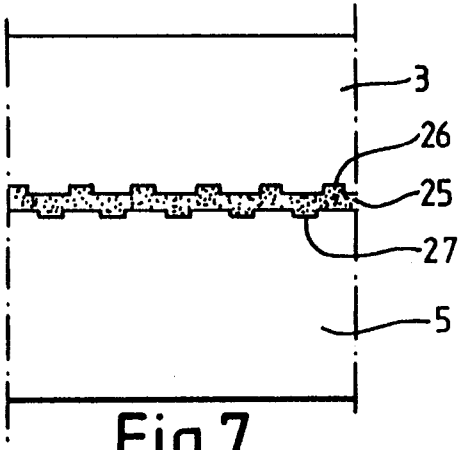
FIG. 7 is a partial longitudinal sectional view of an alternative mounting assembly.

FIG. 7 shows an alternative embodiment in which a mount 3 is permanently bonded to a base 5 by resilient means comprising a body 25 of elastomeric material. In such an embodiment, the base 5 could contain standard dovetail clamps for securing the base 5 to a gun barrel. Alternatively, the body 25 may be bonded directly to a gun barrel—that is, the gun barrel would then serve as the base 5. It will be appreciated that the embodiment of FIG. 7 may be designed to have controlled resilience in all directions, to provide limited relative movement between the mount 3 and base 5 in all directions. The mount 3 and/or base 5 may be formed with corrugations 26 and 27 as shown. These corrugations are not essential, but give increased bonding surface area and could be used, for instance, to give greater resilience longitudinally than laterally (or transversely).

Figure 8:
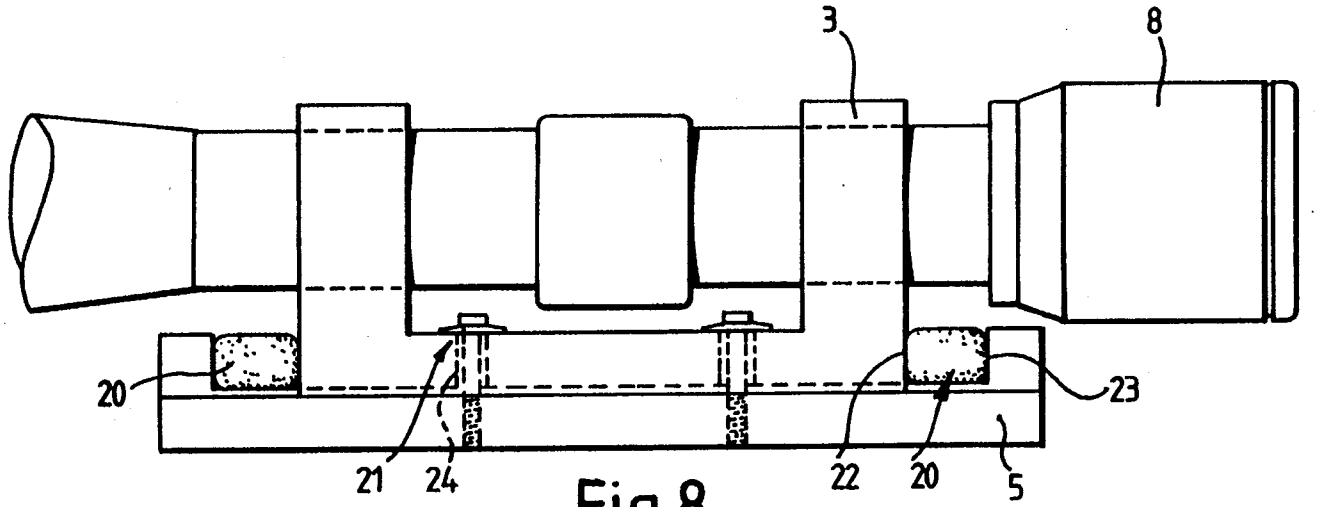
FIG. 8 shows a gun sight mounted on a gun barrel by means of another example of a mounting assembly in accordance with the invention.
Figure 9:
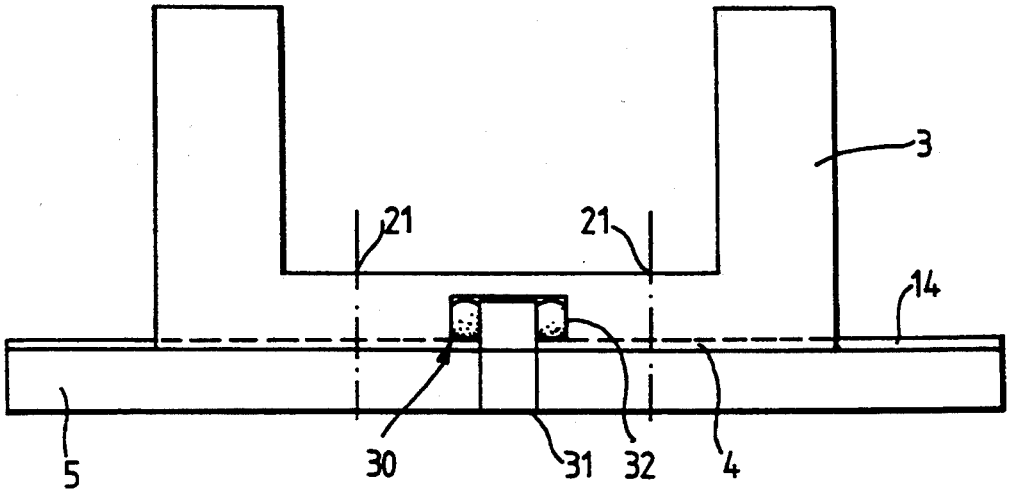
FIG. 9 shows a further example of a mounting assembly in accordance with the invention.

FIGS. 8 and 9 show further alternative embodiments in which resilient means in the form of bodies 20 and 30 of elastomeric material are located separately from clamping bolts 21 for clamping a mount 3 to a base 5.

In FIG. 8, at each end of the mount 3, there is provided a respective one of two resilient bodies 20, disposed between opposing abutment faces 22 and 23 which are provided respectively on the mount 3 and the base 5.

The clamping bolts 21, provided with respective disc spring washers, pass through oversize or slotted holes 24 in the mount 3 so as to allow longitudinal sliding movement of the mount 3 relative to the base 5. It will be appreciated that these clamping bolts 21 could be partially or wholly replaced by designing the mount 3 and the base 5 so as to be interlocking, sliding components capable only of longitudinal relative movement.

In the embodiment of FIG. 9, the resilient body 30 is disposed in a recess 32 formed in the mount 3, and around a peg or stud 31 which is fixed in the base 5. Clamping bolts 21 (indicated in position but not shown in detail in FIG. 9) are provided, and the mount 3 is arranged for longitudinal sliding movement on the base 5, as in the FIG. 8 embodiment. The resilient body 30 may be a single body of bush configuration, fitted around the peg or stud 30. Alternatively, there may be more than one body 30, each disposed at a respective side of the peg or stud 30.

The embodiments of FIGS. 8 and 9 operate in a manner similar to that of the embodiment of FIGS. 3 to 7, such that the resilient bodies 20, 30 allow limited relative longitudinal movement of the mount 3 on the base 5, against the returning force of their resilient bias.

In addition to economy, reliability, durability and consistency, the above described resilient means will be required to provide sufficient longitudinal relative movement capacity, the resistance to such movement preferably rising rapidly and smoothly, being strongly damped to avoid oscillation and with rapid return to datum. The resilient means 20, 30 could readily be located in internal channels in either or both of the mount 3 and base 5 so as to be wholly or substantially hidden from view and thus somewhat protected from the elements.

Figure 10:
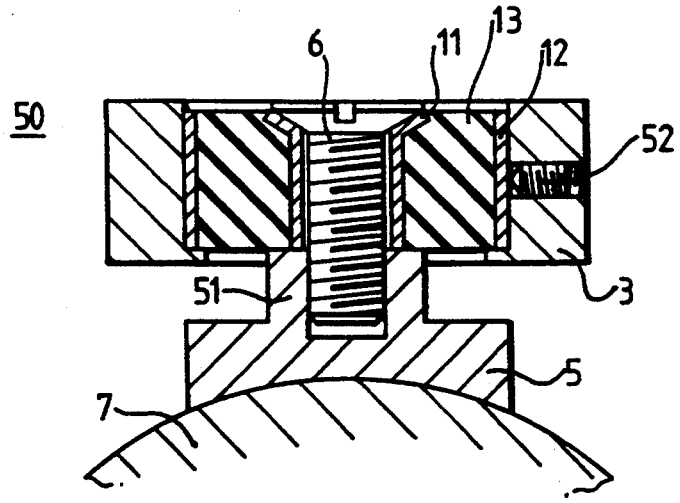
FIG. 10 is a cross-sectional view of part of a gun sight mounted on a gun barrel by means of a yet further example of a mounting assembly in accordance with the invention.

The mounting assembly 50 of FIG. 10 is similar to the embodiment of FIG. 5. However, in FIG. 10, there is no metal-to-metal contact between a mount 3 and a base 5. The base 5 is, in this example, integral with the barrel of a rifle 7, and formed with an upstanding portion 51, against which an inner sleeve of a bush 1 bears, being secured firmly by a fixing bolt 6. One or more grub screws 52 engages an outer sleeve 12 of the bush 1 to prevent movement of the mount 3 with respect to the outer sleeve 12.

It is a particular advantage of the FIG. 10 embodiment that the brush 1 of elastomeric material 13 provides the only physical connection between the mount 3 and the base 5, and the elastomeric material 13 is not used to transmit clamping forces between the mount 3 and the base 5. Thus, the bush 1 may serve to provide a true self-centering resilient effect to absorb shocks from any angle, thus providing accidental knock-absorption qualities as well as recoil absorption.

The absence of metal-to-metal contact between the mount 3 and the base 5 greatly reduces the likelihood of undesirable frictional effects. With no substantial frictional forces resisting a return to datum, the natural equilibrium of the elastomeric material 14 would ensure a very high and satisfactory level of consistent return to datum.

If desired, guide means and/or restraining means may be provided for limiting relative movement between the mount 3 and the base 5 to just one or more directions. Other embodiments of the invention may be constructed or modified to eliminate metal-to-metal contact.

In all of the illustrated embodiments of the invention, it is important that the shock-absorbing means which comprises at least one body of elastomeric material is secured between the base 5 and the mount 3 such that those faces of the body (which will be either the elastomeric material itself or a protective layer thereon such as the sleeve 12, for example) which are in contact with the base 5 and the mount 3 are capable of no movement relative to the base 5 and the mount 3 respectively, in the or each respective line of possible movement of the mount 3 relative to the base 5. This ensures that the elastomeric material between said faces, after resilient deformation to allow limited relative movement between the mount 3 and the base 5, subsequently urges the mount 3 to return accurately to its rest position relative to the base 5, under the resilient bias of the elastomeric material. In the illustrated embodiments, this is achieved by either bonding the body of elastomeric material to the mount 3 or base 5, or providing abutment faces between the body of elastomeric material and the mount 3 or base 5.

Various changes can be made to the invention without departing from the spirit thereof or scope of the following claims.

What we claim is:

1. A mounting assembly for a gun sight, the assembly comprising:

a base which is integral with, secured to, or adapted to be secured to, a gun barrel;

a mount which is integral with, carries, or is adapted to receive, a gun sight; and shock-absorbing means for absorbing shocks which would otherwise be transmitted, in use, between a gun and gun sight:

wherein said shock-absorbing means comprises at least one body of elastomeric material which has first and second faces and is secured between said base and mount such that said first and second faces are in contact with said base and mount respectively and, in at least one direction, no relative movement is possible between said first face and said base and no relative movement is possible between said second face and said mount, the elastomeric material between said faces being resiliently deformable to allow limited relative movement between the mount and the base in at least said one direction, and to urge the mount and base to return to a rest position under the resilient bias of the elastomeric material, following said limited relative movement.

2. A mounting assembly according to claim 1, wherein at least one of said first and second faces is bonded to said base or mount respectively.

3. A mounting assembly according to claim 1, wherein at least one of said first and second faces abuts an abutment face of said base or mount respectively, to prevent, in at least said one direction, relative movement between said first face and said base or between said second face and said mount, respectively.

4. A mounting assembly according to claim 3, wherein the or at least one of the said abutment face(s) extends substantially at right angles to said one direction.

5. A mounting assembly according to claim 1, further comprising a fastening member which passes through said body to fasten said body to said base or mount.

6. A mounting assembly according to claim 5, wherein said fastening member extends in a direction which extends substantially at right angles to said one direction.

7. A mounting assembly according to claim 1, wherein said body comprises a bush of said elastomeric material.

8. A mounting assembly according to claim 1, wherein said elastomeric material comprises a natural and/or synthetic rubber.

9. A mounting assembly according to claim 1, wherein said one direction extends substantially parallel to the longitudinal axis of a gun barrel in use of the mounting assembly.

10. A mounting assembly according to claim 1, wherein means is provided for restraining movement of said elastomeric material transversely of said one direction.

11. A mounting assembly according to claim 1, wherein said elastomeric material is resiliently deformable transversely of said one direction, to allow limited relative movement of said mount and base transversely of said one direction.

12. A mounting assembly according to claim 1, wherein said elastomeric material is resiliently deformable in all directions, to allow limited relative movement of said mount and base in all directions.

13. A mounting assembly according to claim 1, wherein the or each said body provides the only physical connection between said base and mount.

14. A mounting assembly according to claim 1, wherein at least one of said first and second faces is provided on a layer of a protective material in contact with said elastomeric material.

* * * * *